United States Patent [19]

Lane, Sr.

[11] Patent Number: 4,862,672

[45] Date of Patent: Sep. 5, 1989

[54] SEGMENTED HEAD SEAL FOR CUP PACKAGING MACHINE

[76] Inventor: William A. Lane, Sr., 664 S. Wabash, Redlands, Calif. 92373

[21] Appl. No.: 189,529

[22] Filed: May 3, 1988

[51] Int. Cl.[4] ..... B65B 5/00; B65B 7/28

[52] U.S. Cl. ..... 53/282; 53/485; 53/478; 53/559

[58] Field of Search ..... 219/243; 53/282, 373, 53/453, 478, 559, 485

[56] References Cited

U.S. PATENT DOCUMENTS

| | | | |
|---|---|---|---|
| 3,193,978 | 7/1965 | Bader | 53/282 |
| 3,481,109 | 12/1969 | Pavey | 53/282 |
| 4,176,507 | 12/1979 | Mancini | 53/282 |

*Primary Examiner*—W. Donald Bray
*Attorney, Agent, or Firm*—Herb Boswell

[57] ABSTRACT

This invention is directed to a segmented head seal for a cup packaging machine which has independent sealing head segments. The segmented head seal has a mounting plate having an insulator plate attached thereto. Attaching to the insulator plate is a support plate. Attached to the support plate are a plurality of locator assembly members. Movably linked to each individual locator assembly member is an independent sealing member. The links between the sealing members and the locator assembly members allow the sealing member to move on the locator assembly member. The locator assembly members are attached to the support plates with one or more bias springs located in openings in the locator assembly members between the support plate and the sealing blocks. The springs bias the sealing blocks away from the support plate whereby when the segmented head seal is utilized to seal cups on a cup packaging machine, the springs in association with the links between the locator assembly member and the sealing members, allow the sealing members to independently float and engage the cups being sealed.

15 Claims, 2 Drawing Sheets

SEGMENTED HEAD SEAL FOR CUP PACKAGING MACHINE

BACKGROUND OF INVENTION

This invention is directed to a segmented head seal for a cup packaging machine wherein individual sealing blocks are linked together to form a composite segmented head seal.

For use in the fast food and other industries, packaging cups have been developed for containing individual servings of condiments and other products. These cups allow for packaging, storing and dispensing of premeasured protected amounts of these condiments or other food products. Typically these cups are utilized to dispense individual servings of catsup, mustards, sauces, salad dressings and other similar type products.

These packaging cups include a cup body which has a product reservoir surrounded by a lip. A cover or seal is sealed to the lip to seal the contents within the reservoir of the cup. To use the cup, the seal or cover is pealed back off of the lip of the cup exposing the contents in the reservoir.

Generally, the body of these cups, that is the portion of the cups excluding the cover or seal, is formed out of a resilient material as, for instance, polyethylene utilizing vacuum forming techniques. In forming the cups a sheet of polyethylene is placed over a die and the sheet vacuum formed into the die forming a matrix of joined cup bodies in the sheet. Generally the matrices of joined cup bodies are in 4 by 4 or 5 by 5 matrices whereby each perform sheet will ultimately yield 16 or 25 individual cups when they are separated from one another.

The cups are filled and sealed while they are still attached to one another in the matrix of joined cup bodies. Thus, a material sheet having matrix of preformed cup bodies formed therein is loaded onto a packaging machine, the cups are filled then sealed and then the individual cups are separated one from another.

Typically since the above referred to cups are formed by vacuum forming, there can be irregularities in the thicknesses of the lips of the cup resulting from the vacuum forming process. This arises because there may be uneven stretching during vacuum forming of the polyethylene sheet resulting from the stresses at the edges of the sheet being different than the stresses at the center of the sheet.

Known head seals for cup packaging machines, hereinafter referred to as preform cup machines, utilize a solid sealing head. This head is sized and shaped to contact one half of a matrix of a sheet of cup bodies as, for instance, in a 4 by 4 matrix by simultaneously contacting and sealing the cover onto 8 cup bodies at a time. Normally this is done by sealing two rows of 4 columns each across the width of the sheet of cup bodies, advancing the sheet of cup bodies underneath the head seal and sealing the remaining two rows of 4 columns each.

Because the thicknesses of the cup lips can vary within a particular sheet of joined cup bodies, imperfect seals can be formed in individual cups. These cups are then subject to leakage. Leaking cups, of course, have to be discarded. Generally a leaking cup will not be detected until pressure is applied to the cup. This often happens during shipping when the cups, which are packaged in bulk, are jostled against one another. A leaking cup not only loses its contents and thus becomes useless but it also contaminates the outsides of other cups and these then also have to be discarded because of the deposits located on them.

The above referred to preformed cup machines are engineered for high speed operation and high volume production. As with any machine ultimately wear will occur. Generally since the head seals are supported by the sides and large pressures are utilized for sealing the covering material to the cup body, wear of the head seal will first occur in the center of the head seal. With a head seal which has started to wear, irrespective of whether or not the cup bodies are perfectly formed, ineffective seals can be formed because of the differences of pressure exerted by a worn head seal over the center cups opposed to the edge cups on a sheet of joined cups. This leads to premature failure of these one piece solid head seals.

BRIEF DESCRIPTION OF THE INVENTION

In view of the above it is a broad object of this invention to provide for new and improved head seals. It is a further object of this invention to provide for new and improved segmented head seals wherein individual sealing blocks are independently movable on a segment head seal so as to effectively seal a sheet of joined cup bodies irrespective of differences in thickness of the cup body material or inevitable wear and change of tolerances in the head seal itself. It is a further object of this invention to provide a segmented head seal which, because of the engineering principles inherent therein is capable of a long and useful lifetime.

These and other objects as will become evident from the remainder of this specification are achieved in a segmented head seal for a preform cup machine which includes a sealing block holding means for supporting a plurality of sealing blocks. A support means is provided for attaching and supporting the sealing block holding means on the cup machine. A plurality of individual sealing blocks, each having a sealing face, are independently movably supported on the sealing block holding means whereby each of the respective sealing blocks is capable of moving on the sealing block holding means independent of movement of any of the other sealing blocks.

A linking means is utilized to independently movably link each of the sealing blocks on the sealing block holding means allowing for the independent movement of the respective sealing blocks on the sealing block holding means. A biasing means for independently biasing each of the respective sealing blocks on the sealing block holding means is incorporated in the segment head seal. The biasing means allows for independent alignment of each of the sealing blocks as well as the application of sufficient sealing pressure to a cup irrespective of the thickness of the lip of the cup compared to the thickness of the lip of neighboring cups.

Advantageously in a segmented head seal of the invention a plate means can be utilized for supporting further assemblies with a plurality of locator assembly means attached to the plate means. An equal plurality of sealing block means are utilized for forming seals. One of these sealing block means is independently linked to each of the respective locator assembly means.

At least one opening can be formed in each of the locator assembly means and a biasing means can be positioned in the opening. The biasing means is thus located between the plate means and each sealing block means. As so located, the biasing meand can bias the sealing block means away from the plate means.

The sealing block means can be linked to the locator assembly means utilizing interlinking flange and channel means. A flange on one of the locator assembly means or sealing block means, preferredly on the locator assembly means, fits into a channel on the other, preferredly on the sealing block means. The channel means is oversized with respect to the flange means allowing for movement between the channel means and the flange means whereby the sealing block means is movably located or linked on the locator assembly means.

In utilizing a segmented head seal of the invention an improved process of sealing a cover to a cup body is achieved. This process is effected by locating a segmented head seal on a cup fill and seal packaging machine. The segmented head seal is constructed to have a plurality of sealing blocks independently movable on the segmented head seal. The segmented head seal is contacted against a plurality of side by side cups and the individual sealing blocks are allowed to individually move against the cups being sealed to effect a seal on these cups.

BRIEF DESCRIPTION OF THE DRAWINGS

This invention will be better understood when taken in conjunction with the figures wherein.

This invention utilizes certain principles and/or concepts as are set forth in the claims appended hereto. Those skilled in the packaging arts will realize that these principles and/or concepts are capable of being utilized in a variety of embodiments which may differ from the exact embodiment utilized for illustrative purposes herein. For this reason this invention is not to be construed as being limited solely to the illustrative embodiments, but should only be construed in view of the claims.

DETAILED DESCRIPTION OF THE INVENTION

For use on a preform cup packaging machine a matrix of joined cup bodies is utilized. As described above, this matrix is formed by vacuum forming a sheet of precursor material on a mold. Generally, depending upon the amount of product which is desired to be dispensed in the cup, each row in a matrix of joined preformed cups will contain a number of cup bodies as, for instance, 4 or 5. Further, a number of columns will be formed in each of the matrix as, for instance, also 4 or 5. Thus, if a 4 by 4 matrix of joined cup bodies is utilized, each sheet of joined cup bodies would be capable of yielding 16 individual cups and if a 5 by 5 matrix is used, 25 individual cups would result.

Figure 1:
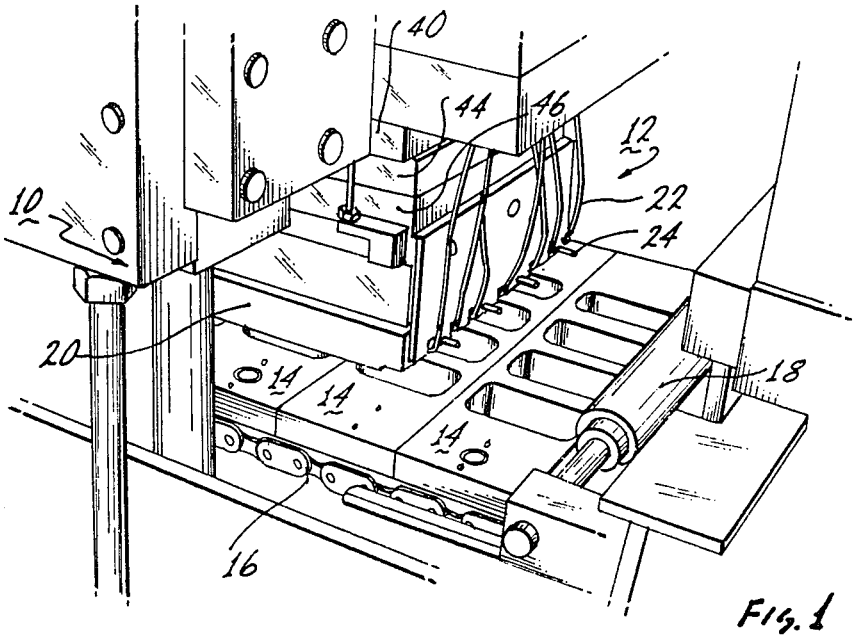
FIG. 1 is an isometric view of the sealing station of a cup packaging machine showing a segmented head seal of the invention located on this machine in association with a movable conveyor belt of the machine.

FIG. 1 shows the sealing station of a preform cup machine wherein a row of cups having 4 columns therein would be processed. In FIG. 1 the preform cup packaging machine is generally identified by the numeral 10 and the sealing station generally identified at the numeral 12. The machine 10 would utilize a continuous belt formed of individual belt segments collectively identified by the numeral 14. These belt segments typically are blocks of aluminum machined to close tolerances to be exactly the same thickness across the plane of the segment. They are linked together utilizing a linked belt 16 which drives the segments from right to left as seen in FIG. 1.

A matrix of joined cup bodies would be located in adjacent belt segments 14. Thus, for the machine 10 illustrated in FIG. 1 which is a 4 column machine, typically a matrix of 16 cups, 4 columns by 4 rows, would be utilized with this matrix of joined cups occupying 4 adjacent belt segments 14. Upstream from the sealing station 12 is a cover roller 18. It is utilized in laying (but not sealing) a continuous sheet of cover material over the cup bodies as they advance on the belt segments 14.

After the cover material is laid onto the cup bodies, the linked belt 16 advances the cup bodies underneath the head seal 20. The head seal 20 contains a plurality of individual sealing blocks as hereinafter described in greater detail, each of which is heated. Heating wires 22 can be seen in FIG. 1 leading from the head seal 20 to appropriate control mechanisms, not separately identified or numbered. In any event, the hot sealing blocks within the head seal 20 are brought down on the top of the covering material pressing it against the lips of the cup bodies to heat seal the cover material to the cup bodies.

Typically the belt segments 14 would be surfaced with a teflon, silicone rubber or other non-stick material and a teflon, silicone rubber or other non-stick type drape (not separately shown or numbered) would be suspended underneath the bottom of the head seal utilizing suspension pegs 24 illustrated in FIG. 1 on the head seal 20. The drape would form a non-stick surface underneath the head seal 20 to prevent contamination of the head seal.

After having the covering material sealed onto the tops of the cup bodies at the sealing station 12 of the machine 10 the belt segments 14 move to the left. The cup bodies having a sealed cover attached thereto are then separated from one another at a further cutting station on the cup packaging machine which is downstream from the sealing station 12.

Figure 3:
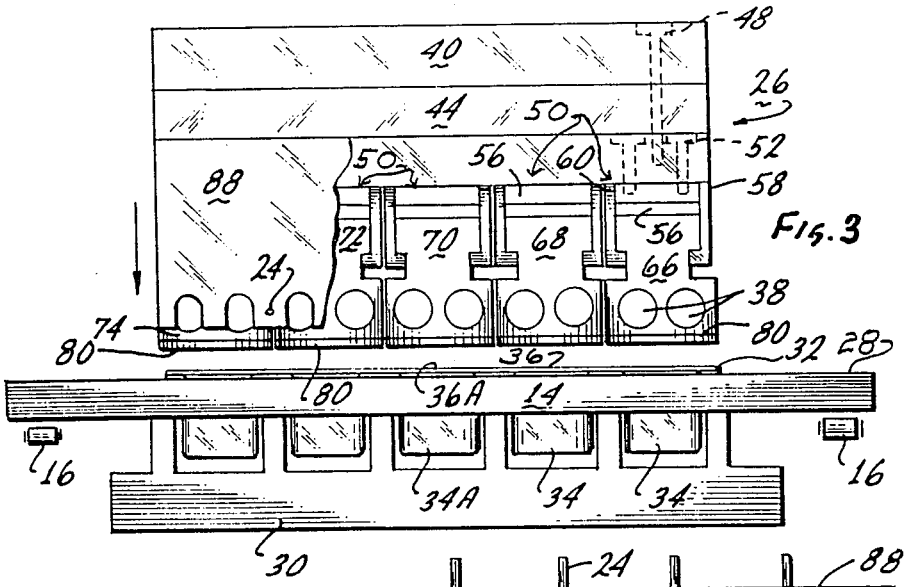
FIG. 3 is a partially cut away front elevational view of a sealing station such, as that of FIG. 1, showing a segmented head seal of the invention and a matrix of side by side cups formed in a sheet of material with the cups located within a belt segment of the packaging machine and located over an anvil of the packaging machine.
Figure 4:
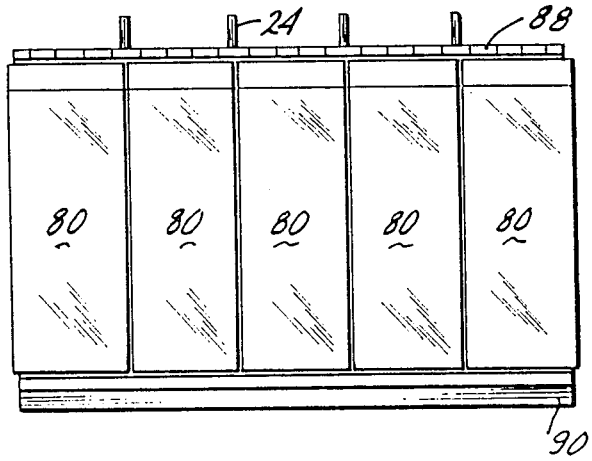
FIG. 4 is a bottom plan view of the segmented head seal of FIGS. 2 and 3.
Figure 5:
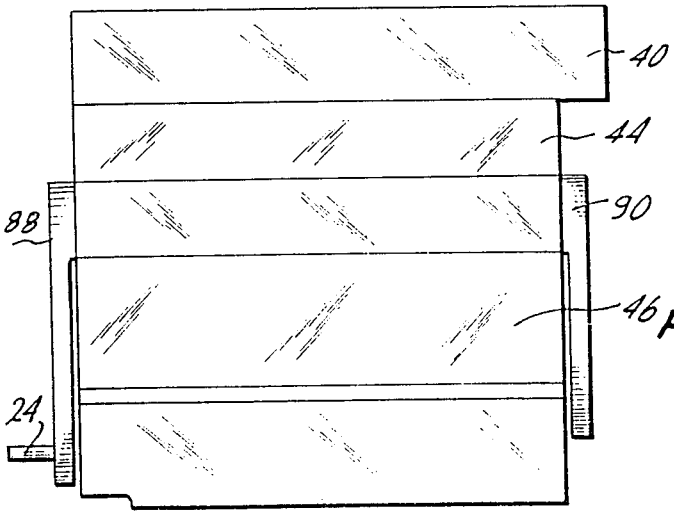
FIG. 5 is a side elevational view of a segmented head seal of FIGS. 2 and 3.

Referring now to FIG. 3, a segmented head seal 26 of the invention is illustrated in greater detail. This head seal 26 is utilized to concurrently seal 5 columns of cups on a matrix of joined cup bodies. In FIG. 3, the head seal 26 is shown located in association with one of the linked belt segments 14 which is positioned over an anvil 30. Located in the belt segment 14 is a matrix 32 of joined cup bodies. The individual cup bodies are identified by the numeral 34 whereas the continuous joined lip of the bodies 34 is generally identified at the numeral 36. The matrix 32 is supported on the belt segment 14 with its lip 36 resting on the top surface 28 of the belt of the belt segment 14.

As is evident from FIG. 3, the anvil 30 located underneath the linked belt segment 14 supports the linked belt segment 14. For sealing a covering material (not shown in FIG. 3. to the matrix 32 of joined cup bodies, the head seal 26 is brought down against the top of the matrix 32 pressing it down onto the linked belt segment 14 which in turn is supported by the anvil 30. The anvil 30, of course, would be located and adequately supported on the body of the cup packaging machine being utilized.

A plurality of bores collectively identified by the numeral 38 in the head seal 26 allow for location of individual heaters within the individual segments of the head seal 26 to heat these individual segments. During operation, the individual segments of the segmented head seal 26 are heated and the head seal 26 is brought down against the top of a covering material to heat and pressure seal the covering material to the material 32.

It is evident from FIG. 3 that if, for instance, the material thickness of the lip 36 at area 36-A was thicker than at other locations and if a monolithic head seal was utilized, while the seal may be formed at the thicker area 36-A ineffective seals would be formed at other areas along the lip 36 because the extra thickness of the material at area 36-A would effectively shield the remainder of the material 32 from receiving equal pressure of the head seal 26. Thus, ineffective seals may be formed between the covering material and the lip 36 of the matrix 32 in other areas distal from the area 36-A.

Figure 2:
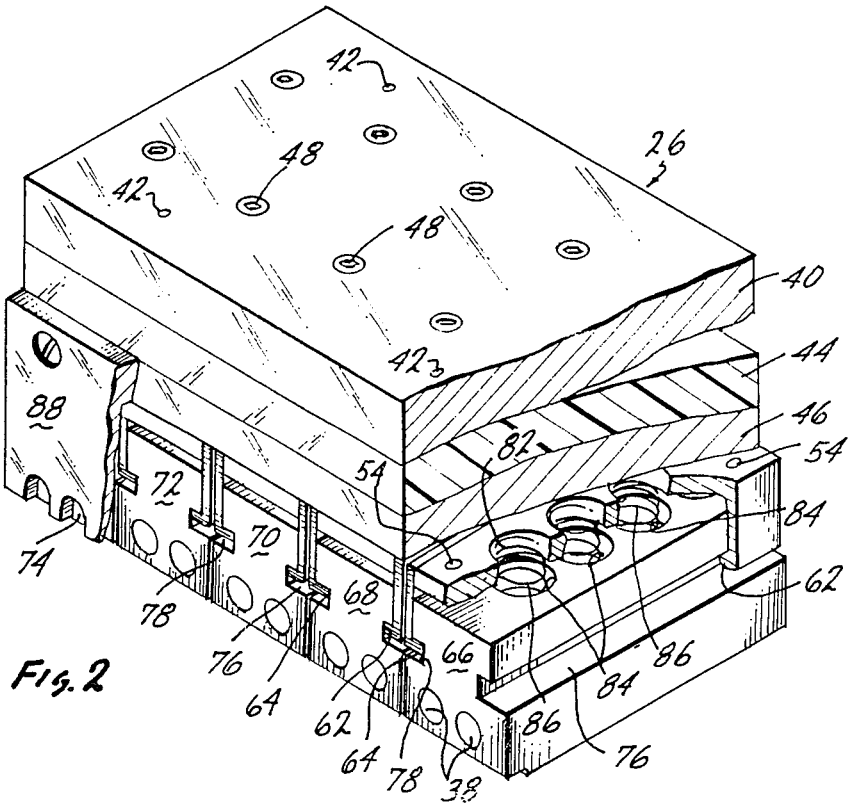
FIG. 2 is an isometric view in partial section of an isolated segmented head seal of the invention.

The individual component parts of the segmented head seal 26 are best seen in FIG. 2. While the head seal 20 of FIG. 1 is a 4 element head seal and the head seal 26 of FIGS. 2 through 5 are a 5 element head seal, like numerals will be utilized to identify like parts between FIGS. 1 and the other Figures for certain structural components which are common to both the head seals 20 and 26.

The uppermost component of the head seal 26 is a mounting plate 40. It is utilized to attach the head seal 26 to other components of a cup packaging machine by appropriately attaching the mounting plate 40 to the cup packaging machine utilizing threaded mounting holes collectively identified by the numeral 42. Appropriate bolts or the like are threaded into these mounting holes to mount the head seal 26 to the cup packaging machine.

Directly underneath the mounting plate 40 is insulator plate 44. The insulator plate 44 is formed of an appropriate insulating material as, for instance, epoxy glass or the like. Directly underneath the insulator plate 44 is a cover plate 46. Hex head bolts collectively identified by the numeral 48 are utilized to attach the cover plate 46, the insulator plate 44 and the mounting plate 40 into a unified structure. One of these hex head bolts 48 is shown in phantom line in FIG. 3 to show how the components 40, 44 and 46 are joined together.

Five individual locator assembly members collectively identified by the numeral 50 in turn are joined to the cover plate 46 via bolts shown in phantom line at 52 in FIG. 3; however, only two of these bolts 52 are shown in FIG. 3 for simplicity of the drawing. A number of the bolts 52 would be utilized to join each individual locator assembly 50 by threading into tapped holes collectively identified by the numeral 54 in FIG. 2.

Each of the locator assembly members 50 has a central section 56 which serves as the mounting plate to the cover plate 46. Attached to the central section 56 are right and left sections 58 and 60 respectively. The sections 58 and 60 generally are welded onto the central section 56 such that the locator assembly member 50 is an integral member.

The right section 58 includes a flange 62 on its end opposite the central section 56 and the left section 60 includes a flange 64 on its end opposite the central section 56. The flanges 62 and 64 are located so as to be directly opposing one another at the same level and further they are oriented toward one another.

Individual sealing blocks 66, 68, 70, 72 and 74 are identically formed to include a right hand channel collectively identified by the numeral 76 and a left hand channel collectively identified by the numeral 78. Both the right and the left channel 76 and 78 on each of the sealing blocks 66 through 75 are formed parallel to the sealing face, collectively identified by the numeral 80, on each of the respective sealing blocks.

The channels 70 and 76 are formed oversize with respect to the flanges 62 and 64. Thus, when a sealing block as, for instance sealing block 66 is slid into an appropriate locator assembly member 50, it is free to move up and down through a certain limit of movement defined by the flanges 62 and 64 abutting against the top upper inside surface of the channels 76 and 78 or the bottom inside surface of the channels 76 and 78. It is evident that the rear of any of the respective sealing block 66 through 74 can move independent from the front of the sealing blocks 66 through 74, that is the rear of a sealing block could be lifted while the front of the sealing block still remains in a downward oriented position.

Also, because the channels 76 and 78 are oversized with respect to the flanges 62 and 64, the individual sealing blocks 66 through 74 are capable of exhibiting a certain amount of motion across the sealing face 80 of the sealing blocks, that is the right or the left hand edge of a respective sealing block could be raised an incremental amount compared to the left hand edge. All of this allows for variability in both of the thicknesses of the material of the cups which are being sealed and for variability of wear of the component parts of the segmented head seal 26.

The central sections 56 of each of the locator assembly members 50 includes a number of openings, collectively identified by the numeral 82 seen in FIG. 2. Further, each of the sealing blocks 66 through 74 include a like number holes 84 formed in their upper surfaces. The holes 84 are drilled into the individual block 66 through 74 through approximately $\frac{1}{3}$ of the depth of these blocks.

A plurality of compression springs collectively identified by the numeral 86 are positioned in the individual holes 84 and openings 82 in the blocks 66 through 74 respectively and the central sections 56 of the locator assembly members 50. The cover plate 46 fits on top of the compression springs 86 and serves to compress the spings 86 between it, the cover plate 46, and the bottom of the holes 84. This tenses the compression springs 86.

To assemble the segmented head seal 26, the individual sealing blocks 66 through 74 are slid into one of the locator assembly members 50. The compression springs 86 are then located in the openings 82 and holes 84. An individual locator assembly member 50 having an appropriate sealing block and springs located therein is then attached and secured to the cover plate 46 with bolts 52. In securing the locator assembly member 50 to the cover plate 46, this compresses the individual springs 86 within the assembly being attached. Next a further locator assembly member 50 having an appropriate sealing block 68 and springs 86 located therein is mounted to the cover plate 46. This process is continued to further mount the remaining sealing blocks 70, 72 and 74.

When all of the sealing blocks 66 through 74 have been appropriately mounted in their locator assembly members 50, heating elements can then be located within the heating bores 38. Next a front retaining plate 88 and a rear retaining plate 90 are secured to the cover plate 46. This secures the heating element within the heating bores 38 and prevents any front to back movement of the sealing blocks 66 through 74 in their respective locator assembly members 50. The completed segmented head seal 26 of the invention is now ready to be mounted onto an appropriate cup packaging machine.

Together the flanges 62 and 64 fit into the channels 76 and 78 forming linking means for attaching the respective sealing blocks 66 through 74 to the locator assembly members 50. These linking means also allow for movement of the sealing block 66 through 74 and their respective locator assembly members 50 through an amount of movement limited by contact of the flanges 62 and 64 against the inside surfaces of the channels 76 and 78. The opposing inwardly directed flanges 62 and 64 on each of the locator assembly members 50 give these locator member assemblies a somewhat C shape in cross section. The small upper block like segment, not separately identified or numbered, of each of the individual sealing blocks 66 through 74 which is defined by the channels 76 and 78 fits within the inside of this C shape and the larger lower block like segment, also not separately identified or numbered which includes the heater bores 38 of the sealing blocks 66 through 74, is located downward and external of the flanges on the periphery of this C shape. This allow the individual sealing blocks 66 through 74 to float in the locator assembly members 50 against the bias of the compression springs 86.

Normally about 600 psi total head pressure would be utilized in sealing the covers to the cups on a cup packaging machine. For a 4 segment head seal this would allow for about 150 pounds of sealing pressure per segment. For a 5 segment head seal with the same pressure, i.e. 600 psi, this would allow for 120 pounds per square inch of individual sealing pressure per individual cup. The compression springs 86 are chosen to operate within these individual perameter ranges as, for instance, between about 60 per square inch to about 150 per square inch. Any irregularities in the thickness of the flanges of the cups being sealed or in wear of the head seal is automatically compensated for by the individual floating action of the sealing blocks 66 through 74 against the springs 86 in the locator assembly members 50.

What is claimed is:

1. A segmented head seal for a cup machine which comprises:

sealing block holding means for supporting a plurality of sealing blocks;

support means for attaching and supporting said sealing block holding means on said cup machine;

a plurality of sealing blocks each having a sealing face, each of said sealing blocks independently movably supported on said sealing block holding means such that each respective sealing block is capable of moving on said sealing block holding means independent of any other sealing block;

at least one of said sealing block holding means and said plurality of sealing blocks including linking means for independently movably linking each of said sealing blocks on said sealing block holding means whereby said respective sealing blocks each can independently moved on said sealing block holding means between first and second positions;

said linking means includes a plurality of interlocking channel means and flange means for linking said respective sealing blocks to said sealing block holding means, said plurality of channel means located on one of said sealing block holding means and said plurality of sealing blocks and said plurality of flange means located on the other of said sealing block holding means and said plurality of sealing blocks; and said respective channel means of an oversized dimension with respect to said respective flange means whereby a respective flange means fits into a respective channel means.

2. A segmented head seal of claim 1 including:

biasing means for independently biasing each of said respective sealing blocks towards its first position on said sealing block holding means.

3. A segmented head seal of claim 1 wherein:

each of said respective sealing blocks includes a heater cavity means for accepting a heater within said respective sealing block to independently heat said respective sealing block.

4. A segmented head seal of claim 1 wherein:

said plurality of channel means located on said plurality of sealing blocks and said plurality of flange means are located on said sealing block holding means.

5. A segmented head seal of claim 4 wherein:

each of said sealing blocks is formed as an elongated block having said sealing face on a surface of said block and elongated left and right sides extending from said sealing face; and said channel means comprise each of the respective sides of said sealing blocks including an elongated channel extending into said respective side with said channels in each of the respective sealing blocks positioned parallel to said sealing face of the respective sealing block.

6. A segmented head seal of claim 4 wherein:

said sealing block holding means includes a plurality of locator assembly members; and said plurality of flange means comprise each of said respective locator assembly members having a pair of elongated opposing flanges which are oriented towards one another.

7. A segmented head seal of claim 4 wherein:

each of said sealing blocks is formed as an elongated block having said sealing face on a surface of said block and elongated left and right sides extending from said sealing face;

said channel means comprise each of the respective sides of said sealing blocks including an elongated channel extending into said respective side with said channels in each of the respective sealing blocks positioned parallel to said sealing face of the respective sealing block;

one of said sealing blocks fitting into each of said locator assembly members with said flanges on each of the respective locator assembly members positioned in the channels on the respective sealing blocks; and said respective channels movable on said respective flanges to allow for movement of said respective sealing blocks on said respective locator assembly members.

8. A segmented head seal for a cup machine which comprises:

a plate means for supporting further assemblies;

a plurality of sealing block means for forming seals;

a plurality of locator assembly means for movably retaining and positioning said sealing block means, said plurality of locator assembly means equal in number to the number of said plurality of sealing block means, said plurality of locator assembly means located on said plate means; and means for independently movably linking each respective sealing block means to a respective locator assembly means.

9. A segmented head seal of claim 10 including:

a plurality of openings, at least one of said openings located in each of said locator assembly means; and a plurality of biasing means equal to the total number of said openings in said plurality of locator assembly means, each of said biasing means located in one of said openings and positioned between said plate means and the respective sealing block means associated with the respective locator assembly means in which the respective opening is located, said respective biasing means biasing the respective sealing block means away from said plate means.

10. A segmented head seal of claim 9 wherein:

each of said locator assembly means includes a multiplicity of openings.

11. A segmented head seal of claim 8 wherein:

each of said locator assembly means includes an attaching section for attaching to said plate means and at least one linking section which extends from said central section away from said plate means; and each of said locator assembly means further including a linking means located on said linking section, said linking means for interlinking with the respective sealing block means located on the respective locator assembly means.

12. A segmented head seal of claim 11 wherein:

each of said locator assembly means includes a right and a left linking section attaching to and extending from said central section; and each of said right and left linking sections including a linking means located on the respective linking sections, each of said linking means interlinking with the respective sealing block means located on the respective assembly means.

13. A segmented head seal of claim 12 wherein:

said respective linking means each including a flange means positioned on said respective linking sections distal from said respective central sections; and each of said sealing block means including left and right channel means for interlinking with said flange means, said respective sealing block means movably located on said respective locator assembly means by interlinking of said respective flange means in said respective channel means.

14. A segmented head seal of claim 13 including:

each of said locator assembly means including a multiplicity of openings in said central section of the respective locator assembly means; and a plurality of biasing means equal to the total number of said openings in said plurality of locator assembly means, each of said biasing means located in one of said openings and positioned between said plate means and the respective sealing block means associated with the respective locator assembly means in which the respective opening is located, said respective biasing means biasing the respective sealing block means away from said plate means.

15. A segmented head seal of claim 14 wherein:

said linking means further defines limits of movement of each of said respective sealing block means in its respective assembly locator means, said limits of movement defined by engagement of a respective flange means of the respective assembly locator means against a surface of its interlinking channel means.

* * * * *

UNITED STATES PATENT AND TRADEMARK OFFICE

CERTIFICATE OF CORRECTION

PATENT NO. : 4,862,672

DATED : SEPTEMBER 5, 1989

INVENTOR(S) : WILLIAM A. LANE, SR.

It is certified that error appears in the above-identified patent and that said Letters Patent is hereby corrected as shown below:

Column 3, line 1, "meand" should be --means--.

Column 5, line 16, "material 32" should be --matrix of joined cup bodies 32--.

Column 5, line 24, "material 32" should be --lip 36--.

Column 6, line 14, "75" should be --74--.

Column 6, line 17, "70 and 76" should be --76 and 78--.

Column 6, line 56, "spings" should be --springs--.

Column 8, line 6, "moved" should be --move--.

Column 8, line 31, insert --are-- between "means" and "located".

Column 9, line 19, "10" should be --8--.

Signed and Sealed this

Twentieth Day of November, 1990

*Attest:*

*Attesting Officer*

HARRY F. MANBECK, JR.

*Commissioner of Patents and Trademarks*